US010682777B2

(12) United States Patent
Huisman et al.

(10) Patent No.: US 10,682,777 B2
(45) Date of Patent: Jun. 16, 2020

(54) BLADE SET AND HAIR CUTTING APPLIANCE

(71) Applicant: KONINKLIJKE PHILIPS N.V., Eindhoven (NL)

(72) Inventors: Simon Reinald Huisman, Eindhoven (NL); Geert Veenstra, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 127 days.

(21) Appl. No.: 15/569,198

(22) PCT Filed: Apr. 14, 2016

(86) PCT No.: PCT/EP2016/058157

§ 371 (c)(1),
(2) Date: Oct. 25, 2017

(87) PCT Pub. No.: WO2016/173846

PCT Pub. Date: Nov. 3, 2016

(65) Prior Publication Data

US 2018/0099427 A1 Apr. 12, 2018

(30) Foreign Application Priority Data

Apr. 28, 2015 (EP) ..... 15165442

(51) Int. Cl.
*B26B 19/38* (2006.01)
*B26B 19/06* (2006.01)

(52) U.S. Cl.
CPC ..... *B26B 19/3846* (2013.01); *B26B 19/063* (2013.01); *B26B 19/3893* (2013.01)

(58) Field of Classification Search
CPC ..... B26B 19/02; B26B 19/06; B26B 19/063; B26B 19/38; B26B 19/3846; B26B 19/12
USPC ..... 30/43.91–43.92, 42, 44, 208–210
See application file for complete search history.

(56) References Cited

U.S. PATENT DOCUMENTS 2,151,965 A 3/1939 Hanley
3,111,755 A * 11/1963 Fütterer et al. ..... B26B 19/06 30/43.92
3,238,617 A * 3/1966 Larson ..... B26B 21/36 30/42
3,675,325 A 7/1972 Michelson
3,844,035 A * 10/1974 Bauerle ..... B26B 19/105 30/43.92
4,348,810 A * 9/1982 Oda ..... B26B 19/06 30/210

(Continued)

FOREIGN PATENT DOCUMENTS

EP 2857157 A1 4/2015
WO 0121518 A1 3/2001

(Continued)

*Primary Examiner* — Jason Daniel Prone

(57) ABSTRACT

A cutting appliance and a blade set that includes a cutter and a stationary blade. The stationary blade has a guide slot. A cutter is movably arranged within the guide slot. The cutter includes, at a side thereof facing away from a skin facing wall of the stationary blade, an elevated spacing arrangement associated with a toothed leading edge of the cutter, and being configured for spacing a substantially flat bottom surface of the at toothed leading edge of the cutter away from the skin facing wall.

18 Claims, 7 Drawing Sheets

(56) References Cited

U.S. PATENT DOCUMENTS 5,093,999 A * 3/1992 Raetz ..... B23D 63/18 30/210
8,146,253 B2 * 4/2012 Sato ..... B26B 19/04 30/43.92
8,186,064 B2 * 5/2012 Pragt ..... B26B 19/06 30/208
9,027,252 B2 * 5/2015 Moseman ..... B26B 19/3846 30/208
9,782,903 B2 * 10/2017 Stapelbroek ..... B26B 19/3846
9,789,617 B2 * 10/2017 Stapelbroek ..... B26B 19/3846
9,873,203 B2 * 1/2018 Stapelbroek ..... B26B 19/06
9,908,249 B2 * 3/2018 Ackermans ..... B26B 19/06
10,081,114 B2 * 9/2018 Sablatschan ..... B26B 19/3846
10,124,498 B2 * 11/2018 Sablatschan ..... B26B 19/3846
10,252,429 B2 * 4/2019 Sablatschan ..... B26B 19/3846
10,300,618 B2 * 5/2019 Stapelbroek ..... B26B 19/06
10,377,050 B2 * 8/2019 Zuidervaart ..... B26B 19/3846
2006/0156549 A1 * 7/2006 O ..... B26B 19/3846 30/43.91
2016/0229072 A1 * 8/2016 Stapelbroek ..... B26B 19/06
2016/0236362 A1 * 8/2016 Stapelbroek ..... B26B 19/3846
2016/0236363 A1 * 8/2016 Stapelbroek ..... B26B 19/3846
2016/0271814 A1 * 9/2016 Bennik ..... B26B 19/06
2017/0028574 A1 * 2/2017 Iaccarino ..... B26B 19/063
2017/0113361 A1 * 4/2017 Feijen ..... B26B 19/3846
2017/0144319 A1 * 5/2017 Sablatschan ..... B26B 19/3846
2017/0246751 A1 * 8/2017 Vredeveld ..... B26B 19/06
2017/0259439 A1 * 9/2017 Van Eibergen Santhagens ..... B26B 19/06
2018/0009121 A1 * 1/2018 Stapelbroek ..... B26B 19/3846

FOREIGN PATENT DOCUMENTS

WO 2009095198 A1 8/2009
WO 2013150412 A1 10/2013

* cited by examiner

BLADE SET AND HAIR CUTTING APPLIANCE

This application is the U.S. National Phase application under 35 U.S.C. § 371 of International Application No. PCT/EP2016/058157, filed on Apr. 14, 2016, which claims the benefit of International Application No. 15165442.3 filed on Apr. 28, 2015. These applications are hereby incorporated by reference herein.

FIELD OF THE INVENTION

The present disclosure relates to a (hair) cutting appliance, particularly to a cutter and a stationary blade of a blade set for such an appliance. The present disclosure further relates to corresponding manufacturing methods.

BACKGROUND OF THE INVENTION

WO 2013/150412 A1 discloses a cutting appliance and a corresponding blade set of a cutting appliance. The blade set comprises a stationary blade and a cutter, wherein the cutter can be reciprocatingly driven with respect to the stationary blade for cutting hair.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

Common electric razors are not particularly suited for cutting hair to a desired variable length above the skin, i.e., for precise trimming operations. Similarly, common hair trimmers are not particularly suited for shaving. Furthermore, combined shaving and trimming devices show several drawbacks since they basically require two cutting blade sets and respective drive mechanisms.

The above WO 2013/150412 A1 tackles some of these drawbacks by providing a blade set comprising a stationary blade that houses the cutter such that a first portion of the stationary blade is arranged at the side of the cutter facing the skin, when used for shaving, and that a second portion of the stationary blade is arranged at the side of the cutter facing away from the skin when in use. Furthermore, at a toothed cutting edge, the first portion and the second portion of the stationary blade are connected, thereby forming a plurality of stationary teeth that cover respective teeth of the cutter. Consequently, the cutter is guarded by the stationary blade.

It is noted that US patent document U.S. Pat. No. 2,151,965 A discloses a hair clipper having an outer plate and an inner plate which are brought in oscillating motion with respect to each other. The outer plate of this hair clipper has flanges turned under the serrated or toothed edges of the inner plate. The outer plate has openings at its folding edge. The edges of these openings cooperate with the toothed edges of the inner plate to cut hairs. U.S. Pat. No. 2,151,965 A discloses that the inturned flange of the outer plate resiliently engages the face of the inner plate which is faced away from the skin during operation of the disclosed hair clipper.

However, there is still a need for improvement in hair cutting devices and respective blade sets. This may particularly involve user comfort related aspects, performance related aspects, and manufacturing related aspects. Manufacturing related aspects may involve suitability for series production or mass production.

SUMMARY OF THE INVENTION

It is an object of the present disclosure to provide an alternative blade set, particularly a cutter blade thereof, that may contribute to a pleasant user experience in both shaving and trimming operations. More preferably, the present disclosure may address at least some drawbacks inherent in known prior art hair cutting blades as discussed above, for instance. It would be further advantageous to provide for a blade set that may exhibit an improved operating performance while preferably reducing the time required for cutting operations. It is further desired to present adequate corresponding manufacturing approaches.

According to a first aspect of the present disclosure, a blade set for a cutting appliance is presented, said blade set being arranged to be moved through hair in a moving direction to cut hair, said blade set comprising:

a stationary blade comprising a first wall arranged to serve as a skin facing wall when in operation, a second wall at least partially offset from the first wall, such that the first wall and the second wall define therebetween a guide slot arranged to receive a cutter, at least one toothed leading edge jointly formed by the first wall and the second wall, wherein the at least one toothed leading edge comprises a plurality of teeth, and wherein the first wall and the second wall are connected at a frontal end of the at least one leading edge, thereby forming tips of the teeth, and a cutter comprising a main portion, particularly a substantially flat main portion obtained from sheet metal material, at least one toothed leading edge protruding from the main portion, the at least one toothed leading edge comprising a plurality of teeth, the cutter being movably arranged within the guide slot defined by the stationary blade, such that, upon relative motion between the cutter and the stationary blade, the at least one toothed leading edge of the cutter cooperates with corresponding teeth of the stationary blade to enable cutting of hair caught therebetween in a cutting action, wherein the cutter, at a bottom side thereof facing the second wall, comprises an elevated spacing arrangement associated with the at least one toothed leading edge, the spacing arrangement being configured for spacing a substantially flat bottom surface of the at least one toothed leading edge of the cutter away from the second wall.

This aspect is based on the insight that the second wall of the stationary blade may, on the one hand, strengthen and stiffen the blade set such that the first wall may be shaped in a considerably thin fashion so as to enable cutting of hairs very close to a user's skin. Further, the second wall may serve as a retainer for the cutter so as to prevent the at least one toothed leading edge of the cutter to become significantly deflected in the course of the hair cutting operation. It has been observed that hairs that enter the respective leading edge of the stationary blade where the stationary blade and the cutter cooperate to cut hair may actually urge or lift the cutter away from the first wall of the stationary blade. In other words, respective cutting edges of the teeth of the cutter might be deflected and moved away from corresponding cutting edges of the teeth of the stationary blade. In the alternative, the stationary blade or even both the guard and the cutter may be deflected due to the cutting action. Therefore, the current disclosure is also applicable to embodiments that comprise relatively thin-walled stationary blades, wherein the cutter is considerably stiff when compared to the double-walled stationary blade, particularly the first wall thereof. A design goal of a blade set in accordance with some aspects of the disclosure is to allow the first wall to be particularly thin so as to cut hairs close to the skin. As a consequence, when respective loads are generated at the cutting zone between the cutter and the first wall of the stationary blade, primarily the stationary blade may tend to be deflected and bent, rather than the cutter.

As a consequence, the hair cutting performance may be impaired. Further, hairs may be pulled rather than cut when the clearance or gap between the respective cutting edges of the teeth of the cutter and the stationary blade becomes too large. So as to avoid an excessive deflection of the toothed leading edge of the cutter, or in some cases of the stationary blade or even of both components, as will generally be the case, the elevated spacing arrangement may be provided which is arranged to contact the second wall and to prevent the cutter from being excessively flexed or deformed when in operation. The elevated spacing arrangement may be arranged to prevent a rearward deflection of the toothed leading of the cutter which would basically involve that the teeth of the cutter are at least partially lifted away from the corresponding teeth of the stationary blade. User comfort may be enhanced in this way. Further, skin irritations, due to undesired hair pulling may be significantly reduced. This of course may involve that in an unbiased state at least a small (vertical) assembly clearance is provided at the cutting edges. In other words, the elevated spacing arrangement does not necessarily urge the teeth of the cutter into permanent contact with the first wall and the second wall of the stationary blade.

As used herein, the cutter may be referred to as movable cutter blade. As used herein, the first wall may be referred to as first wall portion. As used herein, the second wall may be referred to a second wall portion. As used herein, a top side or top surface may be generally regarded as the side or surface that is facing the skin when the hair cutting appliance is in operation. Consequently, the bottom side or bottom surface may be regarded as the side or surface that is facing away from the top side and facing away from the skin when the cutting appliance is in operation.

In one embodiment of the blade set, the elevated spacing arrangement is elevated with respect to the bottom surface of the cutter and arranged to contact the second wall of the stationary blade at a portion thereof that is associated with a recessed gap portion so as to space respective teeth of the cutter away from the recessed gap portion. Generally, the recessed gap portion may be regarded as a recessed channel for accommodating cut hair sections so as to prevent them from being stuck between the second wall of the stationary blade and the cutter. To some extent, the recessed channel may be referred to as a discharge channel arranged for discharging or moving away cut hair sections from the bottom side of the cutter.

In a further refinement of this embodiment, the gap portion is formed at the guide slot at the second wall in the vicinity of at least one toothed leading edge, wherein the elevated spacing arrangement is arranged to contact the second wall at a gap portion or adjacent to the gap portion.

It is preferred that the elevated spacing arrangement is arranged to keep clear (or: not to block) the gap portion. This may involve that the elevated spacing arrangement is provided at a location of the cutter that is offset from the gap portion in the longitudinal direction. In the alternative, the elevated spacing arrangement may be provided at a region of the cutter that faces the gap portion. In this case, it may be preferred that the elevated spacing arrangement is arranged in an interrupted or discontinuous fashion, in terms of the lateral extension of the elevated spacing arrangement. In other words, it is preferred that the elevated spacing arrangement does not bridge or connect neighboring teeth of the toothed leading edge of the cutter. Even though the bottom side of the cutter is not necessarily directly involved in the hair cutting action, an accommodation, or even a discharge of cut hair sections may be provided at the bottom side, particularly when the second wall of the stationary blade is provided with an appropriate gap portion.

In yet another refinement, the gap portion is an at least partially concavely shaped internal indentation, wherein the gap portion is arranged to provide a remaining gap between the guide slot and the at least one toothed leading edge of the cutter mounted therein, and wherein the gap portion is adapted to accommodate hairs, particularly cut hair sections. Preferably, the gap portion is arranged to accommodate the cut hair sections.

On the one hand, the gap portion is advantageous to facilitate discharging and removing of cut hair sections. However, on the other hand, the recessed gap portion basically provides a space which may be entered by the toothed leading edge of the cutter when being deformed (for instance, rearwardly bent) when in operation.

As indicated above, the deflection or deformation of the cutter may be attributed to cutting forces. Particularly when a larger number of hairs is caught and cut at the same time instant, respective cutting forces and corresponding counter forces may increase which may cause an at least partially occurring lifting of the teeth of the cutter, and/or of the first wall of the stationary blade. This may even involve that hairs are clamped between the teeth of the stationary blade (at the first wall thereof) and the teeth of the cutter without being appropriately cut. This may cause skin irritations and unpleasant harm to the user as the respective hairs may be basically pulled at the user's skin rather than being smoothly cut.

In another embodiment, the elevated spacing arrangement is configured to urge a top surface of the at least one toothed leading edge of the cutter into close contact with the first wall, particularly with legs of the teeth of the stationary blade. Hence, the respective cutting edges may be in close and tight contact so as to safely cut hairs that are trapped therebetween.

In yet another embodiment, the elevated spacing arrangement is arranged to prevent a rearward deflection of the at least one toothed leading edge of the cutter. As used herein, a rearward deflection may be regarded as deflection wherein tooth portions, particularly tips of the tooth are lifted or bent away from their counterparts at the first wall of the stationary blade. As a consequence, the teeth of the cutter may be at least sectionally brought out of engagement with the corresponding teeth of the stationary blade. Therefore, a prevention or at least a significant limitation of the rearwardly-oriented deflection of the toothed leading edge of the cutter further improves the cutting performance.

It may be generally preferred that the elevated spacing arrangement is bulge-shaped or dome-shaped. This may particularly apply to a cross-section viewed in a plane perpendicular to the lateral direction. Generally, the elevated spacing arrangement may be provided with a convex shape. The convex shape of the elevated spacing arrangement facilitates a sliding contact between the elevated spacing arrangement and the second wall of the stationary blade.

Particularly when the elevated spacing arrangement comprises a plurality of interrupted portions, also a cross-section thereof when viewed in a plane that is perpendicular to the longitudinal direction may be bulge-shaped or dome-shaped or, rather, convexly shaped.

In yet another embodiment, the elevated spacing arrangement comprises an elevated laterally extending spacing ridge protruding from the bottom surface of the cutter. Preferably, the spacing ridge is a continuous elevated laterally extending spacing ridge. The laterally extending spacing ridge is preferably arranged adjacent to tooth bases of respective teeth of the cutter and adapted to contact the second wall of the stationary blade. In other words, the spacing ridge is not necessarily present at the teeth as such but at a portion of the cutter that is in close proximity to the teeth. As a consequence, the hair removal capability of the blade set is maintained as the spacing arrangement is not bridging or connecting the teeth of the cutter at the bottom side thereof. Consequently, when a respective embodiment implements a recessed hair-accommodating or even hair-discharging gap portion at the second wall, the gap portion is kept clear to accommodate cut hair sections. It is generally preferred that the spacing ridge is spaced from the toothed leading edge of the cutter towards the main portion of the cutter.

In yet another embodiment, the elevated spacing arrangement comprises a series of elevated spacing elements adapted to a present tooth pitch at the toothed leading edge of the cutter. Generally, the elevated spacing elements may protrude from the bottom surface of the cutter. The elevated spacing elements are adapted to contact the second wall of the stationary blade. Preferably, at the second wall, a depressed lateral extending surface is provided which can be contacted by the elevated spacing elements. Further, in some embodiments, a plurality of elevated spacing elements is provided that are longitudinally aligned, wherein a respective series extends in the lateral direction. Generally, arranging the spacing arrangement in a not continuously extending fashion may have the advantage that the spacing arrangement is interrupted in its lateral extension which enables that cut hair sections may enter respective spaces. Consequently, the hair removal capability may be further enhanced.

In a refinement of the above embodiment, the elevated spacing elements are arranged at the teeth of the cutter, wherein each of the elevated spacing elements is assigned to a respective tooth. In some embodiments, each of the teeth of the cutter is provided with a respective elevated spacing element. However, in alternative embodiments, not necessarily each tooth of the cutter needs to be provided with a respective elevated spacing element. By way of example, the elevated spacing elements may be arranged in a dome-shaped fashion or as spherical segments. It is further preferred that the elevated spacing elements do not protrude beyond the lateral and longitudinal extension of the teeth of the cutter. Hence, the elevated spacing elements do not interfere with the cutting or shearing action. When the elevated spacing elements are provided at the teeth, a lifting up of the teeth from the first wall may be prevented to an even greater extend. In other words, the "leverage" of the elevated spacing arrangement may be even further increased when the respective spacing elements are located adjacent to the longitudinal end of the cutter.

In yet another embodiment, the stationary blade is an integrally formed metal-plastic composite stationary blade, wherein the first wall is at least partially made from metal material, and wherein the second wall is at least partially made from plastic material. The first wall may be substantially defined by a metal component. The second wall may be at least substantially, preferably entirely, defined by a plastic component.

Generally, the stationary blade may be configured to house the cutter in a predefined manner. Particularly, the cutter may be directly received at the stationary blade, i.e. without the need to mount additional biasing or spring elements in the guide slot. More particularly, the cutter may be slidably received in the guide slot. By contrast, conventional blade set arrangements typically include additional biasing elements, such as spring elements, that urge the cutter into close contact with the stationary blade.

Defined mating of the cutter in the guide slot may comprise a defined clearance fit, a transition fit and an interference fit. The defined mating may be achieved by providing a defined clearance and considerably tight tolerances at the guide slot.

The first wall which may be in close contact with the skin, and which is basically configured to cooperate with a cutter to cut hair, preferably comprises considerable stiffness and robustness properties. The first wall may be at least partially made from metal material, particularly from steel material such as stainless steel, for instance. Consequently, even though the first wall preferably may have a small thickness so as to allow cutting hairs close to the skin, it may provide adequate strength. Furthermore, the second wall may be added at the side typically facing away from the skin to further strengthen the stationary blade. The first wall and the second wall may cooperate to form the guide slot.

Preferably, the stationary blade may be obtained from a combined manufacturing process which involves forming the plastic material and bonding the plastic material to the metal material, basically at the same time. It is particularly preferred that the stationary blade consists of the first wall and the second wall, i.e. no further essential components need to be mounted thereto to accomplish the stationary blade. Generally, the stationary blade may be regarded as a two-component part wherein the two components are integrally and fixedly interconnected.

In a refinement of this embodiment, the first wall and the second wall are configured to receive the cutter directly therebetween, particularly without an additional biasing element. Consequently, manufacturing costs and assembly costs may be reduced. In a further refinement of the above embodiment, the metal component further comprises tooth stem portions comprising cutting edges that are configured to cooperate with cutting edges of respective teeth of the cutter to cut hairs that are trapped therebetween when in operation. Hence, cutting edges at the first wall may be formed at the metal component at the tooth stem portions thereof.

In a further refinement of the above embodiment, the metal component comprises at least one anchoring element, particularly at least one positive-fit anchoring element extending from a respective tooth stem portion, wherein the plastic component and the metal component are connected at the at least one anchoring element. The at least one anchoring element may provide a locking geometry that may be engaged by or filled with the plastic material of the plastic component. Generally, the at least one anchoring element may longitudinally protrude from frontal ends of the tooth stem portions.

In one embodiment, the at least one anchoring element is inclined with respect to a top surface of the first wall, particularly rearwardly bended. In a further embodiment, the at least one anchoring element is T-shaped, U-shaped or O-shaped, particularly when viewed from the top. In one embodiment, the at least one anchoring element is rearwardly offset from a top surface of the first wall. This may allow the plastic component to contact and cover a top side of the at least one anchoring element.

In one embodiment, the tips of the teeth are formed by the plastic component, wherein the plastic component further engages the positive-fit anchoring elements at a bonding area between the tooth stem portions of the metal component and the tips of the teeth. Consequently, the plastic component may be firmly bonded to the metal component and connected with the metal component in a form-fit or positive-fit manner at the same time.

Preferably, the second wall is at least substantially made from plastic material. Consequently, the second wall may be adequately formed and shaped so as to strengthen the stationary blade and to provide the proper guidance for the cutter that is movably received in the guide slot. For instance, the gap portion may be formed in the second wall with little efforts. Generally, the second wall may comprise a non-flat or rather three-dimensional shape and extension. It is generally preferred that the second wall is arranged in such a way that, on the one hand, the cutter is received between the first wall and the second wall in a defined clearance fit fashion without the need of additional biasing elements, i.e. without the need of springs, etc. To this end, the second wall may comprise inwardly protruding portions that contact the bottom side or bottom surface of the cutter. However, adjacent to the toothed leading edge of the cutter, a corresponding depression or recess may be formed to define the gap portion. Preferably, the gap portion is a laterally extending gap portion that facilitates discharging or accomodation of cut hair sections.

In yet another embodiment of the blade set, a first leading edge and a second leading edge is provided, each of which jointly formed by respective first and second leading edges of the cutter and the stationary blade, wherein the first leading edge and the second leading edge are spaced from one another and arranged at opposite longitudinal ends of the blade set, wherein a first elevated spacing arrangement is associated with the first leading edge, and wherein a second elevated spacing arrangement is associated with the second leading edge.

Consequently, two directions of a stroke may be used to cut hair. Further, a cutting appliance that is fitted with a respective blade set may be used in different orientations so as to facilitate hair grooming at hard-to-reach body areas. Further, the cutting appliance may be adequately oriented and guided in different configurations which may improve the user's overview at a cutting site.

In still another embodiment, a depressed arrangement is provided at a top surface of the cutter that is opposite to the bottom surface, wherein the depressed arrangement and the elevated spacing arrangement are integrally formed in a corresponding fashion. In other words, an appropriate tool may be urged against the basically flat extending cutter so as to form a depression or deepening which inherently involves the formation of an elevated portion at the opposite side of the cutter. Therefore, by forming a defined depressed arrangement, the spacing arrangement may be mediately shaped. By way of example, the elevated spacing arrangement in accordance with this embodiment may be formed by a ribbing or beading process. Further, appropriate coining and stamping processes may be utilized so as to form the depressed arrangement and the corresponding elevated spacing arrangement. As with this embodiment, no additional parts are required to form the elevated spacing arrangement. Further, the cutter may be stiffened by defining respective integrated ribs. Preferably, the original basically flat overall shape of the sharp cutter teeth edge is maintained in the course of the formation of the integrated depressed/elevated arrangements. This may involve that the intermediate cutter is fixedly clamped when the depressions are formed. In the alternative, a gauging and/or re-shaping process may be provided so as to restore the flat overall shape of the sharp cutter teeth edge after forming the integrated depressed/elevated arrangement.

In an alternative embodiment, the elevated spacing arrangement is formed by a material deposition at the bottom side thereof. By way of example, the elevated spacing arrangement may be formed by the position welding. In some embodiments, the elevated spacing arrangement may be formed from plastic material. Consequently, in these embodiments, the elevated spacing arrangement may be molded to the bottom side or bottom surface of the cutter. Consequently, in the final state, also the cutter may be regarded as a metal plastic composite part. Adequate manufacturing methods such as insert molding, outset molding or overmolding may be utilized.

In another alternative embodiment, the elevated spacing arrangement is formed by bonding at least one separate spacing part to the cutter. For instance, referring to the embodiment implementing a spacing ridge, a corresponding bar or rod may be arranged at the bottom surface and bonded thereto, for instance via welding or soldering.

In another alternative embodiment, the elevated spacing arrangement is formed by bending a defined portion of the cutter, e.g. by 90° (degrees). Bent tabs may be formed which protrude beyond the bottom surface of the main portion of the cutter. Preferably, respective portions of the tabs are arranged between neighboring teeth.

Preferred embodiments of the invention are defined in the dependent claims. It shall be understood that the claimed method has similar and/or identical preferred embodiments as the claimed device and as defined in the dependent claims.

BRIEF DESCRIPTION OF THE DRAWINGS

Several aspects of the disclosure will be apparent from and elucidated with reference to the embodiments described hereinafter. In the following drawings

DETAILED DESCRIPTION OF THE EMBODIMENTS

Figure 1:
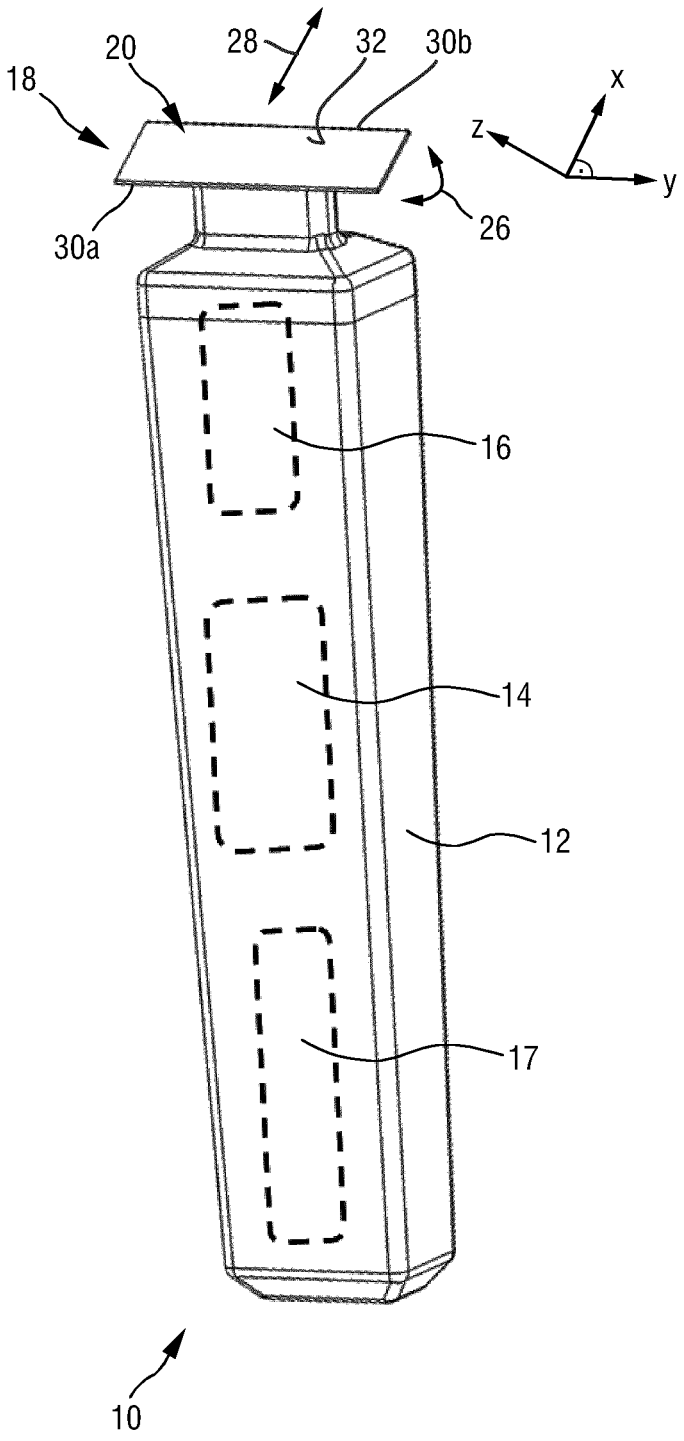
FIG. 1 shows a schematic perspective view of an exemplary electric cutting appliance fitted with an embodiment of a blade set.

FIG. 1 schematically illustrates, in a simplified perspective view, an exemplary embodiment of a hair cutting appliance 10, particularly an electric hair cutting appliance 10. The cutting appliance 10 may comprise a housing 12, a motor indicated by a dashed block 14 in the housing 12, and a drive mechanism or drivetrain indicated by a dashed block 16 in a housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 17.

The cutting appliance 10 may further comprise a cutting head 18. At the cutting head 18, a blade set 20 may be attached to the hair cutting appliance 10. The blade set 20 may be driven by the motor 14 via the drive mechanism or drivetrain 16 to enable a cutting motion. The cutting motion may generally be regarded as a relative motion between a stationary blade 22 and a movable cutter blade or cutter 24 which are shown and illustrated in more detail in FIG. 3, for instance, and will be described and discussed hereinafter. Generally, a user may grasp, hold and manually guide the cutting appliance 10 through hair in a moving direction 28 to cut hair. The cutting appliance 10 may be generally regarded as a hand-guided and hand-operated electrically powered device. Furthermore, the cutting head 18 or, more particularly, the blade set 20 can be connected to the housing 12 of the cutting appliance 10 in a pivotable manner, refer to the curved double-arrow indicated by reference numeral 26 in FIG. 1. In some embodiments, the cutting appliance 10 or, more specifically, the cutting head 18 including the blade set 20 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 18 comprising the blade set 20 is passed along a path at a desired distance relative to the skin.

When being guided or moved through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference having a fixed definition and relation with respect to the orientation of the hair cutting appliance 10 and its cutting head 18 fitted with the blade set 20. That is, an overall orientation of the hair cutting appliance 10 with respect of the to-be-cut hair at the skin may be construed as somewhat unsteady. However, for illustrative purposes, it may be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is further worth mentioning that, for the purpose of the present disclosure, the coordinate system X-Y-Z is generally aligned with main directions and orientations of the cutting head 18 including the blade set 20.

Figure 2:
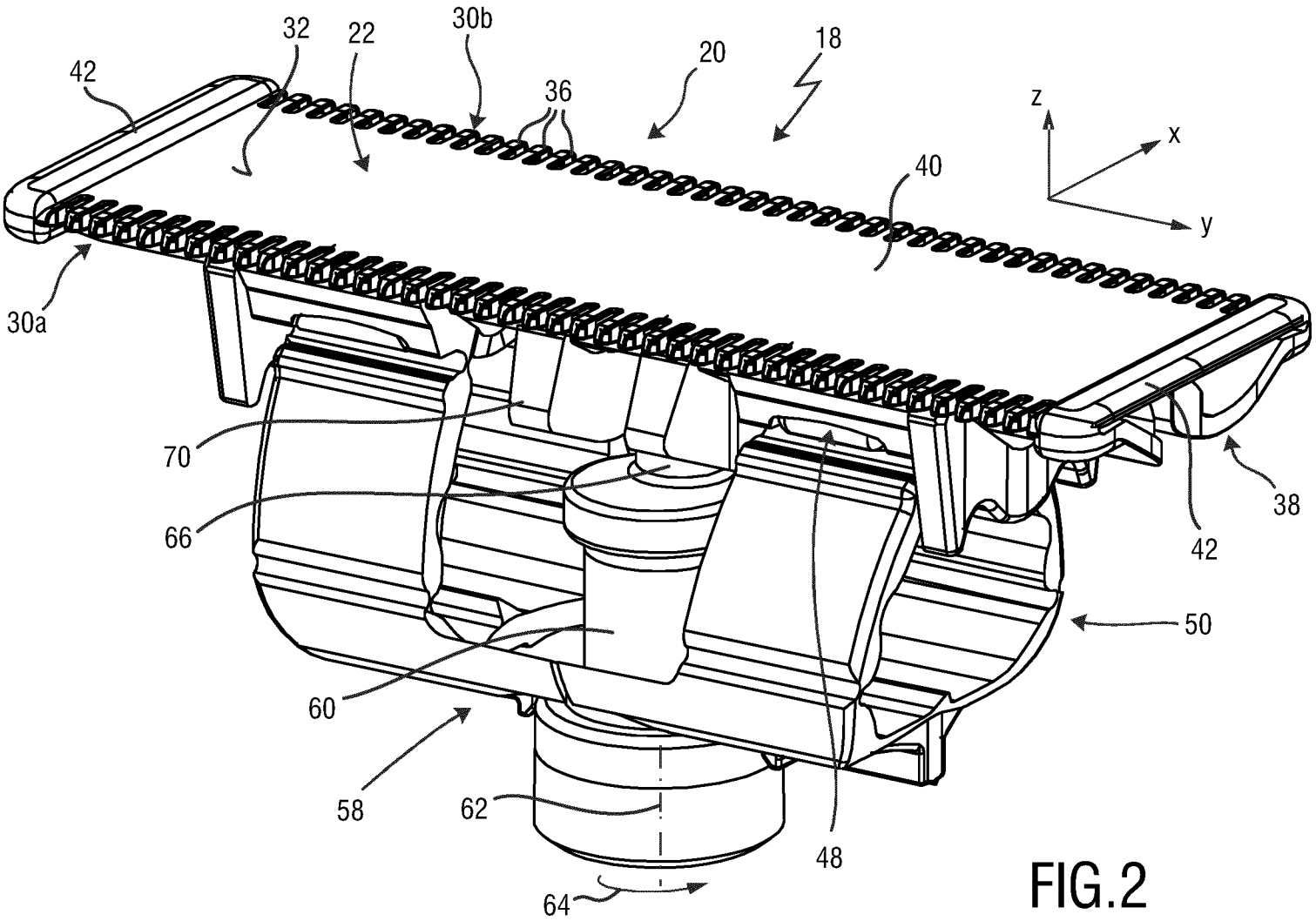
FIG. 2 shows a schematic perspective top view of a cutting head comprising a blade set.

FIG. 2 illustrates a perspective top view of an exemplary embodiment of the cutting head 18 that may be attached to the hair cutting appliance as shown in FIG. 1. The cutting head 18 is provided with the blade set 20 as already indicated above. The blade set 20 comprises a stationary blade 22 and a cutter 24 (hidden in FIG. 2). Further reference is made in this connection to the exploded view of the blade set 20 shown in FIG. 3. The stationary blade 22 and the cutter 24 are configured to be moved with respect to each other, thereby cutting hairs at their respective cutting edges.

The stationary blade 22 further comprises a top surface 32 which may be regarded as a skin-facing surface. Typically, when in operation as a shaving device, the hair cutting appliance 10 is oriented in such a way that the top surface 32 is basically parallel to or slightly inclined with respect to the skin. However, also alternative operation modes may be envisaged, where the top surface 32 is not necessarily parallel or, at least, substantially parallel to the skin. For instance, the hair cutting appliance 10 may be further used for beard styling or, more generally, hair styling.

However, primarily for illustrative purposes, the top surface 32 and similarly oriented portions and components of the hair cutting appliance 10 may be regarded as skin-facing components and portions hereinafter. Consequently, elements and portions that are oriented in an opposite manner may be regarded as rearwardly oriented bottom elements and portions or rather as elements and portions facing away from the skin hereinafter, for the purpose of disclosure.

As already indicated above, the stationary blade 22 may define at least one toothed leading edge 30. As shown in FIG. 2, the stationary blade 22 may define a first leading edge 30*a* and a second leading edge 30*b* that are offset from each other in the longitudinal direction X. The at least one toothed leading edge 30*a*, 30*b* may generally extend in the lateral direction Y. The top surface 32 may be regarded as a surface that is generally parallel to a plane defined by the longitudinal direction X and the lateral direction Y. At the at least one toothed leading edge 30, a plurality of teeth 36 of the stationary blade 22 may be provided. The teeth 36 may alternate with respective teeth slots. The teeth slots define gaps between the teeth 36. Hairs may enter the gaps when the hair cutting appliance 10 is moved through hair in the moving direction 28 (FIG. 1).

The stationary blade 22 may be arranged as a metal-plastic composite component, for instance. In other words, the stationary blade 22 may be obtained from a multi-step manufacturing method that may include providing a metal component 40 (see also FIG. 3) and forming or, more precisely, molding a plastic component 38 including bonding the metal component 40 and the plastic component 38. This may particularly involve forming the stationary blade 22 by an insert-molding process, outsert-molding process or by an overmolding process. Generally, the stationary blade 22 may be regarded as a two-component stationary blade 22. However, since the stationary blade 22 is preferably formed by an integrated manufacturing process, basically no conventional assembly steps are required when forming the stationary blade 22. Rather, the integrated manufacturing process may include a net-shape manufacturing step or, at least, a near-net-shape manufacturing process. By way of example, molding the plastic component 38 which may also include bonding the plastic component 38 to the metal component 40 may readily define a near-net-shape or a net-shape configuration of the stationary blade 22. It is particularly preferred that the metal component 40 is made from sheet metal. It is particularly preferred that the plastic component 38 is made from injection-moldable plastic material.

Forming the stationary blade 22 from different components, particularly integrally forming the stationary blade 22 may further have the advantage that portions thereof that have to endure high loads during operation may be formed from respective high-strength materials (e.g. metal materials) while portions thereof that are generally not exposed to huge loads when in operation may be formed from different materials which may significantly reduce manufacturing costs. Forming the stationary blade 22 as a plastic-metal composite part may further have the advantage that skin contact may be experienced by the user as being more comfortable. Particularly the plastic component 38 may exhibit a greatly reduced thermal conductivity when compared with the metal component 40. Consequently, heat emission sensed by the user when cutting hair may be reduced. In conventional hair cutting appliances, heat generation may be regarded as a huge barrier for improving the cutting performance. Heat generation basically limits the power and/or cutting speed of hair cutting appliances. By adding basically heat insulating materials (e.g. plastic materials) heat transfer from heat-generating spots (e.g. cutting edges) to the user's skin may be greatly reduced. This applies in particular at the tips of the teeth 36 of the stationary blade 22 which may be formed of plastic material.

Forming the stationary blade 22 as an integrally formed metal-plastic composite part may further have the advantage that additional functions may be integrated in the design of the stationary blade 22. In other words, the stationary blade 22 may provide an enhanced functionality without the need of attaching or mounting additional components thereto.

By way of example, the plastic component 38 of the stationary blade 22 may be fitted with lateral protecting elements 42 which may also be regarded as so-called lateral side protectors. The lateral protecting elements 42 may cover lateral ends of the stationary blade 22, refer also to FIG. 3. Consequently, direct skin contact at the relatively sharp lateral ends of the metal component 40 can be prevented. This may be particularly beneficial since the metal component 40 of the stationary blade 22 is relatively thin so as to allow to cut hairs close to the skin when shaving. However, at the same time, the relatively thin arrangement of the metal component 40 might cause skin irritation when sliding on the skin surface during shaving. Since particularly the skin-contacting portion of the metal component 40 may be actually so thin that relatively sharp edges may remain, the risk of skin irritations or even skin cuts may be the higher the thinner the metal component 40 and the stationary blade 22 actually is. It is therefore preferred, at least in some embodiments, to shield lateral sides of the metal component 40. The lateral protecting elements 42 may protrude from the top surface in the vertical direction or height direction Z. The at least one lateral protecting element 42 may be formed as an integrated part of the plastic component 38.

The stationary blade 22 may be further provided with mounting elements 48 that may enable a quick attachment to and a quick release from a linkage mechanism 50. The mounting elements 48 may be arranged at the plastic component 38, particularly integrally formed with the plastic component 38, refer also to FIG. 3. The mounting elements 48 may comprise mounting protrusions, particularly snap-on mounting elements. The mounting elements 48 may be configured to cooperate with respective mounting elements at the linkage mechanism 50. It is particularly preferred that the blade set 20 can be attached to the linkage mechanism 50 without any further separate attachment member.

The linkage mechanism 50 (refer to FIG. 2) may connect the blade set 20 and the housing 12 of the hair cutting appliance 10. The linkage mechanism 50 may be configured such that the blade set 20 may swivel or pivot during operation when being guided through hair. The linkage mechanism 50 may provide the blade set 20 with a contour following capability. In some embodiments, the linkage mechanism 50 is arranged as a four-bar linkage mechanism. This may allow for a defined swiveling characteristic of the blade set 20. The linkage mechanism 50 may define a virtual pivot axis for the blade set 20.

FIG. 2 further illustrates an eccentric coupling mechanism 58. The eccentric coupling mechanism 58 may be regarded as a part of the drive mechanism or drivetrain 16 of the hair cutting appliance 10. The eccentric coupling mechanism 58 may be arranged to transform a rotational driving motion, refer to a curved arrow indicated by reference numeral 64 in FIG. 2, into a reciprocating motion of the cutter 24 with respect to the stationary blade 22. The eccentric coupling mechanism 58 may comprise a driveshaft 60 that is configured to be driven for rotation about an axis 62. At a front end of the driveshaft 60 facing the blade set 22 an eccentric portion 66 may be provided. The eccentric portion 66 may comprise a cylindrical portion which is offset from the (central) axis 62. Upon rotation of the driveshaft 60, the eccentric portion 66 may revolve around the axis 62. The eccentric portion 66 is arranged to engage a transmitting member 70 which may be attached to the cutter 24.

Figure 3:
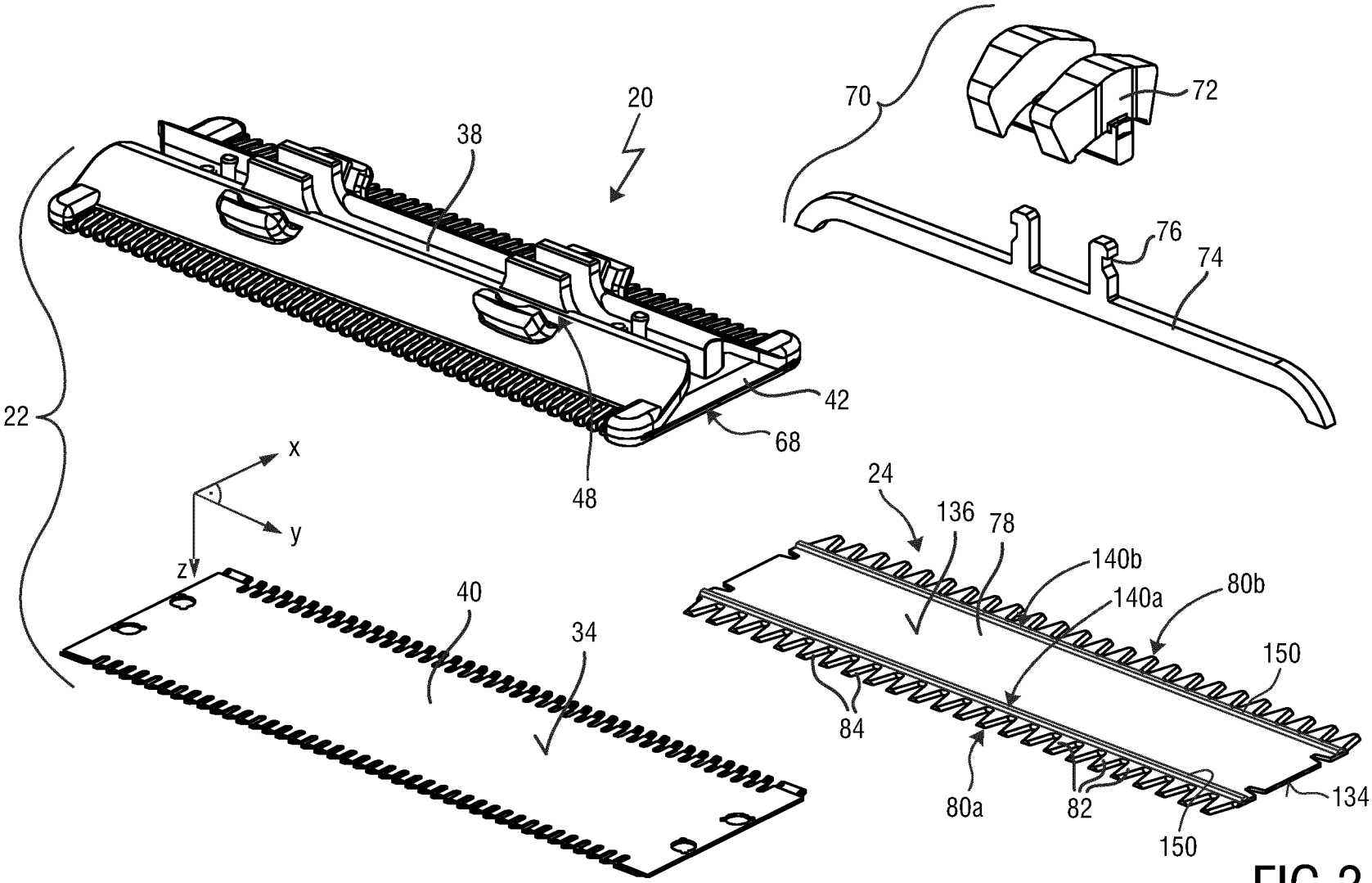
FIG. 3 is an exploded perspective bottom view of a blade set as shown in FIG. 2.

With further reference to the exploded view shown in FIG. 3, the transmitting member 70 will be further detailed and described. The transmitting member 70 may comprise a reciprocating element 72 which may be configured to be engaged by the eccentric portion 66 of the driveshaft 60, refer also to FIG. 2. Consequently, the reciprocating element 72 may be reciprocatingly driven by the driveshaft 60. The transmitting member 70 may further comprise a connector bridge 74 which may be configured to contact the cutter 24, particularly a main portion 78 thereof. By way of example, the connector bridge 74 may be bonded to the cutter 24. Bonding may involve soldering, welding and similar processes. However, at least in some embodiments, the connector bridge 74 or a similar connecting element of the transmitting member 70 may be rather attached to the cutter 24. As used herein, attaching may involve plugging in, pushing in, pressing in or similar mounting operations. The transmitting member 70 may further comprise a mounting element 76 which may be arranged at the connector bridge 74. At the mounting element 76, the reciprocating element 72 may be attached to the connector bridge 74. By way of example, the connector bridge 74 and the mounting element 76 may be arranged as a metal part. By way of example, the reciprocating element 72 may be arranged as a plastic part. For instance, the mounting element 76 may involve snap-on elements for fixing the reciprocating element 72 at the connector bridge 74. However, in the alternative, the mounting element 76 may be regarded as an anchoring element for the reciprocating element 72 when the latter one is firmly bonded to the connector bridge 74.

It is worth mentioning in this regard that the transmitting member 70 may be primarily arranged to transmit a lateral reciprocating driving motion to the cutter 24. However, the transmitting member 70 may be further arranged to serve as a loss prevention device for the cutter 24 at the blade set 20.

FIG. 3 further illustrates the plastic component 38 and the metal component 40 of the stationary blade 22 in an exploded state. It is worth mentioning in this connection that, since it is preferred that the stationary blade 22 is integrally formed, the plastic component 38 thereof typically does not exist as such in an isolated unique state. Rather, at least in some embodiments, forming the plastic component 38 may necessarily involve firmly bonding the plastic component 38 to the metal component 40.

The stationary blade 22 may comprise at least one lateral opening 68 through which the cutter 24 may be inserted. Consequently, the cutter may be inserted in the lateral direction Y. However, at least in some embodiments, the transmitting member 70 may be moved to the cutter 24 basically along the vertical direction Z. Mating the cutter 24 and the transmitting member 70 may therefore involve firstly inserting the cutter 24 through the lateral opening 68 of the stationary blade 22 and secondly, when the cutter 24 is arranged in the stationary blade 22, feeding or moving the transmitting member along the vertical direction Z to the stationary blade 22 so as to be connected to the cutter 24.

Generally, the cutter 24 may comprise at least one toothed leading edge 80 adjacent to the main portion 78. Particularly, the cutter 24 may comprise a first leading edge 80*a* and a second leading edge 80*b* that is longitudinally offset from the first leading edge 80*a*. At the at least one leading edge 80, a plurality of teeth 82 may be formed that are alternating with respective tooth slots. Each of the teeth 82 may be provided with respective cutting edges 84, particularly at their lateral flanks. The at least one toothed leading edge 80 of the cutter 24 may be arranged to cooperate with a respective toothed leading edge 30 of the stationary blade 22 when relative motion of the cutter 24 and the stationary blade 22 is induced. Consequently, the teeth 36 of the stationary blade 22 and the teeth 82 of the cutter 24 may cooperate to cut hair.

The metal component 40 that forms a substantial portion of the first wall 100 comprises a top surface 32 and a bottom surface 34 that is opposite to the top surface. FIG. 3 further illustrates that the cutter 24 is advantageously provided with at least one spacing arrangement 140. As with the embodiment shown in FIG. 3, the blade set 20 comprises two leading edges jointly defined by respective leading edges 30*a*, 30*b* of the stationary plate 22 and 80*a*, 80*b* of the cutter 24. Preferably, a first spacing arrangement 140*a* is associated with the first toothed leading edge 80*a*, and a second spacing arrangement 140*b* is associated with the second leading edge 80*b* of the cutter 24. The spacing arrangements 140 are provided at a bottom side or bottom surface 136 of the cutter 24 that is opposite to a top side or top surface 134 thereof, refer also to FIG. 10 in this respect. The spacing arrangements 140 of the embodiment shown in FIG. 3 implement basically laterally extending spacing ridges 150 that are extending over the entire lateral extension (Y-extension) of the cutter. In the alternative, the at least one ridge 150 may extend over a sub-portion of the overall lateral extension of the cutter 24.

Figure 4:
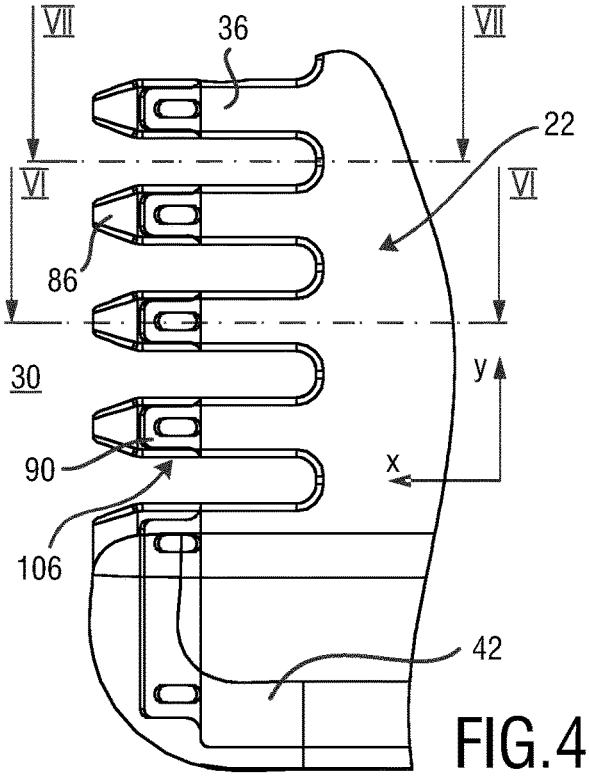
FIG. 4 is a partial top view of a stationary blade of the blade set shown in FIG. 2, wherein hidden edges of the stationary blade are shown for illustrated purposes.

With particular reference to FIGS. 4 to 9, the structure and configuration of an exemplary embodiment of the stationary blade 22 will be further detailed and illustrated. FIG. 4 is a partial top view of the stationary blade 22, wherein hidden portions of the metal component 40 (refer also to FIG. 5) are shown for illustrative purposes. At the teeth 36 of the stationary blade 22, tips 86 may be formed. The tips 86 may be primarily formed by the plastic component 38. However, substantial portions of the teeth 36 may be formed by the metal component 40. As can be best seen from FIG. 5, the metal component 40 may comprise so-called tooth stem portions 88 that may form a substantial portion of the teeth 36. The tooth stem portions 88 may be provided with respective cutting edges 94 that are configured to cooperate with cutting edges 84 of the teeth 82 of the cutter 24. At longitudinal ends of the tooth stem portions 88, anchoring elements 90 may be arranged. The anchoring elements 90 may be regarded as positive fit contact elements which may further strengthen the connection of the metal component 40 and the plastic component 38.

Figure 5:
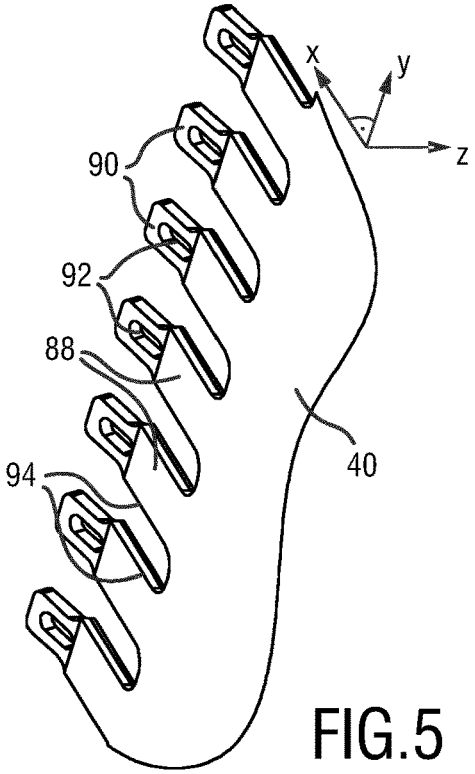
FIG. 5 is a partial perspective bottom view of a metal component of the stationary blade shown in FIG. 3.

By way of example, the anchoring elements 90 may be provided with undercuts or recess portions. Consequently, the anchoring elements 90 may be arranged as barbed anchoring elements. Preferably, a respective portion of the plastic component 38 that contacts the anchoring elements 90 may not be detached or released from the metal component 40 without being damaged or even destroyed. In other words, the plastic component 38 may be inextricably linked with the metal component 40. As shown in FIG. 5, the anchoring elements 90 may be provided with recesses or holes 92. The holes 92 may be arranged as slot holes, for instance. When molding the plastic component 38, plastic material may enter the holes 92. As can be best seen from FIGS. 6 and 8, the plastic material may fill the recesses or holes 92 of the anchoring elements 90 from both (vertical) sides, i.e. from the top side and the bottom side. Consequently, the anchoring elements 90 may be entirely covered by the plastic component 38.

Adjacent to the anchoring elements 90, the tips 86 may be formed. Forming the tips 86 from the plastic component 38 may further have the advantage that the frontal end of the leading edge 30 is formed from a relatively soft material which may be further rounded or chamfered so as to soften edges. Consequently, contacting the user's skin with the frontal ends of the leading edge 30 is typically not experienced as causing skin irritation or similar adverse effects. Also high-temperature spots may be prevented at the tips 36 since the plastic component 38 is typically provided with a relatively low thermal conductivity coefficient, compared with the metal component 40.

Figure 8:
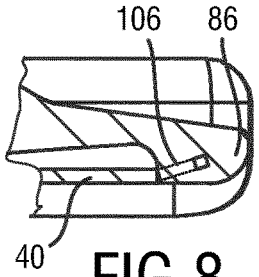
FIG. 8 is an enlarged detailed view of the stationary blade shown in FIG. 6 at a leading edge portion thereof.
Figure 6:
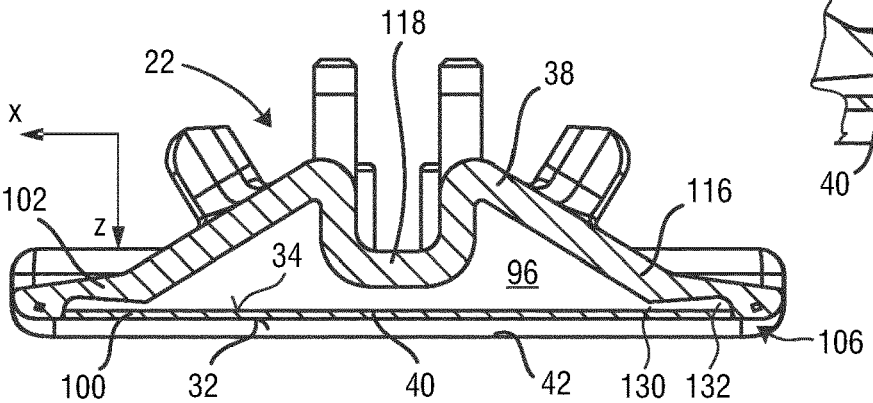
FIG. 6 is a cross-sectional view of the stationary blade shown in FIG. 4 taken along the line VI-VI in FIG. 4.
Figure 7:
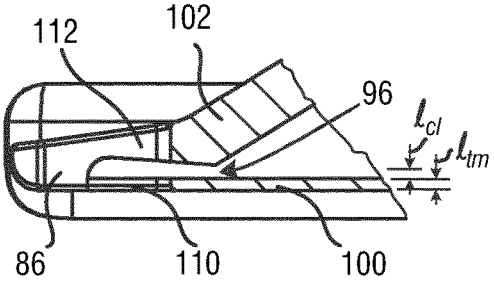
FIG. 7 is a partial cross-sectional side view of the stationary blade shown in FIG. 4 taken along the line VII-VII in FIG. 4.
Figure 9:
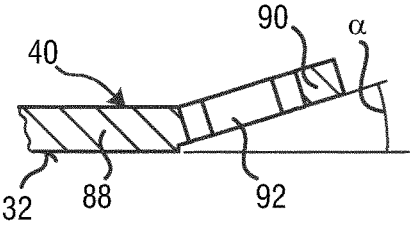
FIG. 9 is an enlarged detailed view of the metal component of the stationary blade basically corresponding to the view of FIG. 8.

As can be best seen from the cross-sectional views of FIGS. 6, 7 and 8, the edges of the tips 86 of the teeth 36 at the frontal ends of the leading edges 30 may be significantly rounded. As can be further seen, the transition between the metal component 40 and the plastic component 38 at the top surface 32 in the region of the teeth 36 may be substantially seamless or step-less. Further reference in this regard is made to FIG. 9. It may be advantageous to shape the anchoring elements 90 such that their top side (skin-facing side) is offset from the top surface 32. Consequently, also the skin-facing side of the anchoring elements 90 may be covered by the plastic component, refer also to FIG. 8. In one embodiment, the anchoring elements 90 may be inclined with respect to the top surface 32. The anchoring elements 90 may be arranged at an angle $\alpha$ (alpha) with respect to the tooth stem portions 88. It may be further preferred that the anchoring elements 90 are rearwardly bended with respect to the top surface 32. At least in some embodiments, the anchoring elements 90 may be thinner than the tooth stem portions 88. This may further enlarge the space which may be filled by the plastic component 38 when molding.

With further reference to FIG. 6, the stationary blade 22 will be further detailed and described. The stationary blade 22 may define and encompass a guide slot 96 for the cutter 24. To this end, the stationary blade 22 may comprise a first wall 100 and a second wall 102. For the purpose of this disclosure, the first wall 100 may be regarded as a skin-facing wall. This applies in particular when the blade set 20 is used for shaving. Consequently, the second wall 102 may be regarded as the wall facing away from the skin. In other words, the first wall 100 may be also referred to as top wall. The second wall 102 may also be referred to as bottom wall.

The first wall 100 and the second wall 102 may jointly define the teeth 36 of the stationary blade. The teeth 36 may comprise a slot or gap for the cutter 24, particularly for the teeth 82 thereof arranged at the at least one toothed leading edge 80. As indicated above, at least a substantial portion of the first wall 100 may be formed by the metal component 40. At least a substantial portion of the second wall 102 may be formed by the plastic component 38. At the exemplary embodiment illustrated in FIG. 6, the second wall 102 is entirely formed by the plastic component 38. Rather, the first wall 100 is jointly formed by the plastic component 38 and the metal component 40. This applies in particular at the leading edge 30. The first wall 100 may comprise, at the respective tooth portions thereof, bonding portions 106, where the plastic component 38 is bonded to the metal component 40. The bonding portions 106 may involve the anchoring elements 90 of the metal component 40 and the plastic material of the plastic component 38 covering the anchoring elements 90.

FIG. 6 and FIG. 8 illustrate a cross-section through a tooth 36, refer also to the line VIII-VIII in FIG. 4. By contrast, FIG. 7 illustrates a cross-section through a tooth slot, refer to line VII-VII in FIG. 4. As can be seen from FIG. 6 and FIG. 7, the first wall 100 and the second wall 102 may jointly form the leading edge 30 including the teeth 36. The first wall 100 and the second wall 102 may jointly define a basically U-shaped lateral cross-section of the respective teeth 36. The first wall 100 may define a first leg 110 of the U-shaped form. The second wall 102 may define a second leg of the U-shaped form. The first leg 110 and the second leg 112 may be connected at the tips 86 of the teeth 36. Between the first leg 110 and the second leg 112 a slot or gap for the cutter 24 may be provided.

As can be further seen from FIG. 6, the first wall 100 may be significantly thinner than the second wall 102 of the stationary blade 22. Consequently, at the skin-facing first wall 100, hair can be cut very close to the skin. It is therefore desirable to reduce the thickness of the first wall 100, particularly of the metal component 40. By way of example, the thickness $l_{tm}$ (refer to FIG. 7) of the metal component 40, particularly at the tooth stem portions 88, may be in the range of about 0.08 mm to 0.15 mm. Consequently, the first wall 100 as such may exhibit a considerably small strength and rigidity. It is therefore beneficial to back up or strengthen the first wall 100 by adding the second wall 102. Since the thickness of the second wall 102 basically does not influence the smallest achievable cutting length (e.g. the length of remaining hairs at the skin), the thickness of the second wall 102, particularly at the respective leading edges 30, may be significantly greater than the thickness $l_{tm}$ of the first wall 100, particularly of the metal component 40. This may provide the stationary blade 22 with sufficient strength and stability.

As can be further seen from FIG. 6, the first wall 100 and the second wall 102 may basically form a closed profile, at least sectionally along their lateral extension. This may particularly apply when the stationary blade 22 is provided with a first and a second leading edge 30*a*, 30*b*. Consequently, the stiffness of the stationary blade 22, particularly the stiffness against bending stress or torsional stress may be further increased.

In one embodiment, the second wall 102 may comprise, adjacent to the second leg 112 at the respective leading edge 30, an inclined portion 116. Assuming that the stationary blade 22 is basically symmetrically shaped with respect to a central plane defined by the vertical direction Z and the lateral direction Y, the second wall 102 may further comprise a central portion 118 adjacent to the inclined portion 116. Consequently, the central portion 118 may be interposed between a first inclined portion 116 and a second inclined portion 116. The first inclined portion 116 may be positioned adjacent to a respective second leg 112 at a first leading edge 30*a*. The second inclined portion 116 may be positioned adjacent to a respective second leg at the second leading edge 30*b*. As can be best seen in FIG. 6, the second wall 102 may therefore comprise a basically M-shaped cross-section primarily defined by the inclined portions 116 and the central portion 118.

Figure 10:
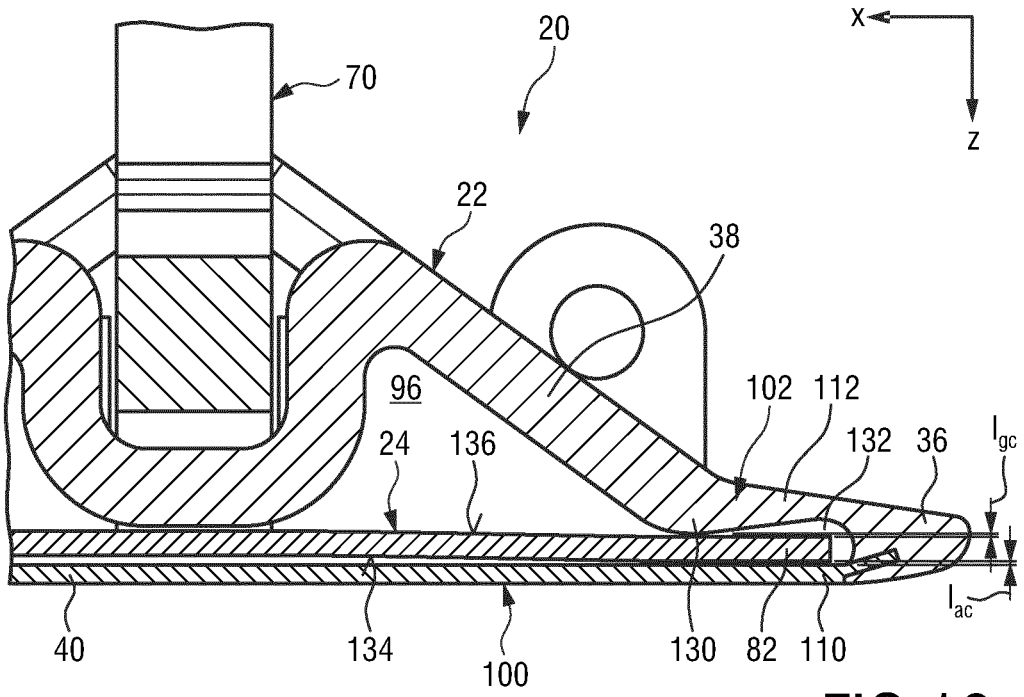
FIG. 10 is an enlarged partial cross-sectional side view of a blade set not comprising the invention as disclosed in the claims.
Figure 11:
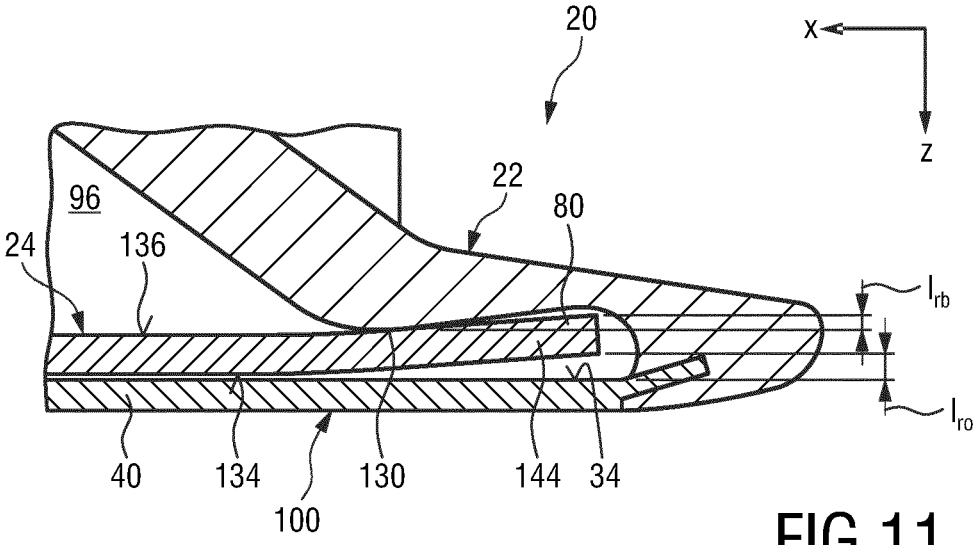
FIG. 11 is a further enlarged partial cross-sectional side view of the blade set of FIG. 10, the cutter being shown in a deformed state.

Further reference is made to FIGS. 10 and 11 illustrating two states of a blade set 20 comprising a cutter 24 that, for illustrative purposes, is not provided with a respective spacing arrangement 140. In FIG. 10, the cutter 24 is shown in a basically unbiased state which may also be referred to as planar or flat state. In FIG. 11, the cutter 24 is shown in a biased state, wherein a longitudinal end of the cutter 24, where the teeth 82 are provided, is bent away or lifted away from the first wall 100.

As best seen in FIG. 10, a protruding contact portion 130 may be provided at the second wall 102. The protruding contact portion 130 is arranged to contact the cutter at the bottom surface 136 thereof so as to bring the cutter 24 into a defined clearance fit contact with the first wall 100, particularly with the metal component 40 thereof. For design purposes, a so-called guide clearance $l_{gc}$ at the bottom side and a so-called assembly clearance $l_{ac}$ may be predefined at the bottom and the top side of the cutter 24, respectively. As a consequence, a resulting defined (overall) clearance or play is provided which simplifies the relative motion of the cutter 24 and the stationary blade 22. It is worth noting in this respect that the specific dimensions guide clearance $l_{gc}$ and assembly clearance $l_{ac}$ are primarily provided for illustrative purposes so as to describe the exemplary embodiment and state of FIG. 10, and shall not be interpreted in a limiting sense. As can be further seen in FIG. 10, adjacent to the protruding contact portion, a gap portion 132 may be provided which basically defines a recess or depression at an inwardly facing surface of the second wall 102. The gap portion 132 defines a gap or space at the bottom side of the teeth 82 of the cutter 24. The gap portion 132 may be provided at the second legs 112 of the teeth 36 of the stationary blade.

When in operation, cutting edges at the top side of the teeth 82 of the cutter 24 cooperate with corresponding cutting edges at the legs 110 of the teeth 36 of the stationary blade 22. In some cases, the protruding contact portion 130 may define a fulcrum about which the toothed leading edge 80 of the cutter 24 may be bent. In other words, a longitudinal end portion of the cutter 24, primarily at the teeth 82 of the toothed leading edge 80, may be lifted away from the bottom surface 34 of the metal component 40. This is to some extend attributable to cutting forces and corresponding counter forces when cutting hair, and to hair sections that got jammed or clamped between the teeth 82 of the cutter 24 and the teeth 36 of the stationary blade 22 rather than being cut and removed.

It is generally preferred to prevent the deflected or bent state of the cutter 24 as shown in FIG. 11. When a bent or lifted portion 144 is provided at the cutter 24, a resulting offset $l_{ro}$ may be defined which actually involves that the cutter 24 and the stationary blade 22 are no longer in close contact or engagement at their cutting edges. Consequently, the cutting performance of the blade set 20 may be significantly decreased. A resulting bent dimension is indicated in FIG. 11 by $l_{rb}$. The dimension $l_{rb}$ describes a resulting deflection or deformation of the toothed leading edge 80 of the cutter 24. It is worth noting in this respect that the specific dimensions resulting bent dimension $l_{rb}$ and resulting offset $l_{ro}$ are primarily provided for illustrative purposes so as to describe the exemplary embodiment and state of FIG. 11, and shall not be interpreted in a limiting sense. As indicated above, in some embodiments the first wall portion 100 rather than the cutter 24 may be deflected or deformed. Typically, both the first wall portion 100 and the cutter 24 will be at least slightly deflected (away from each other) when the blade set is operated due to the cutting forces.

In accordance with at least some embodiments of the present disclosure, a spacing arrangement 140 is provided so as to prevent a flexed or distorted state of the blade 24 involving a more-or-less large bent or lifted portion 144.

Figure 12:
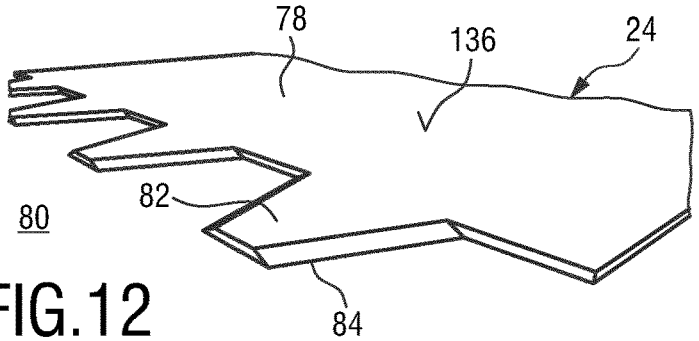
FIG. 12 is a simplified partial perspective bottom view of a cutter.
Figure 13:
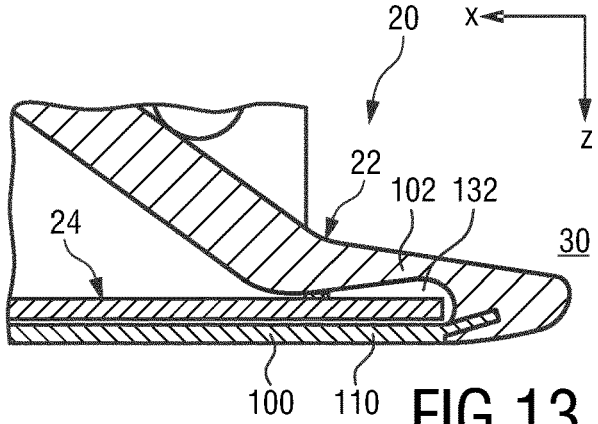
FIG. 13 is a partial cross-sectional side view of a stationary blade comprising a cutter that implements an elevated spacing arrangement.
Figure 14:
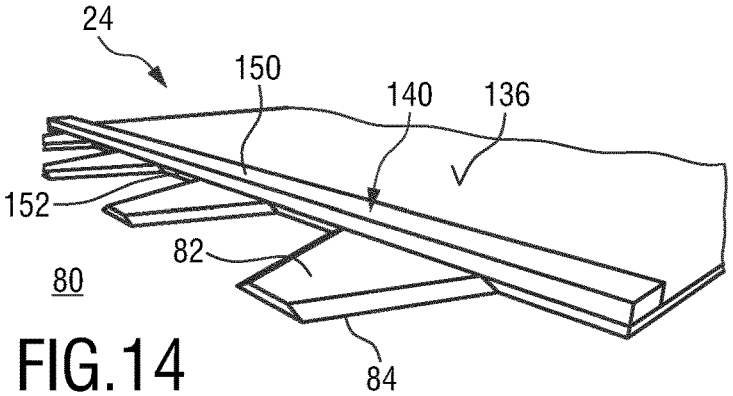
FIG. 14 is simplified partial perspective bottom view of a cutter as shown in FIG. 13.
Figure 15:
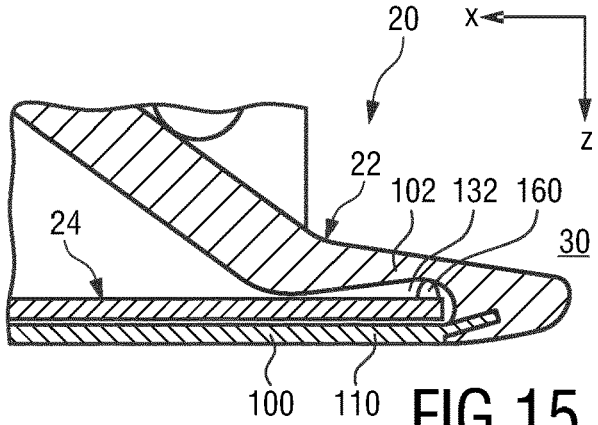
FIG. 15 is partial cross-sections in a side of yet another embodiment of a blade set, a cutter implementing another embodiment of an elevated spacing arrangement.
Figure 16:
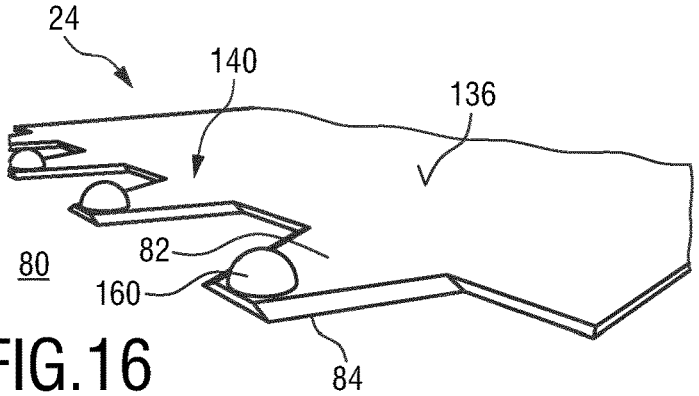
FIG. 16 is simplified partial perspective bottom view of a cutter as shown in FIG. 15.

Further reference is made to FIGS. 12 to 16. FIG. 12, FIG. 14, and FIG. 16 are partial perspective top views of embodiments of a movable cutter blade or cutter 24 that is arranged to be inserted in the guide slot 96 at the stationary blade 22 so as to jointly define the blade set 20 with the stationary blade 22.

As shown in FIG. 12, a conventional arrangement of the cutter 24 may involve a basically flat or planar shape. More particularly, the blade 24 may be obtained from a sheet metal portion. A main or central portion 78 may be provided adjacent to which at least one toothed leading edge 80 is arranged. The leading edge 80 comprises a plurality of teeth 82 that are provided with respective cutting edges 84 so as to cooperate with corresponding cutting edges of the teeth 36 of the stationary blade 22. As shown in FIG. 12, the conventional arrangement of the cutter 24 implements a basically flat bottom side or bottom surface 136, i.e. without elevated spacing parts.

By contrast, the embodiments of the cutters 24 as shown in FIGS. 14 and 16, are provided with a respective spacing arrangement 140. Reference is made to FIG. 13 and FIG. 14. FIG. 13 is a partial cross-sectional side view of a blade set 20 comprising a stationary blade 22 and a cutter 24 that is provided with a spacing arrangement 140. As shown in FIG. 14, the spacing arrangement 140 includes a spacing ridge 150 which is arranged adjacent to the teeth 82 of the leading edge 80. In other words, the spacing ridge 150 is arranged adjacent to tooth bases 152 from which the teeth 82 extend in the longitudinal direction X. The main extension of the elevated ridge 150 coincides with the lateral direction Y. As the spacing ridge 150 is arranged adjacent to but not at the teeth 82, there is no interference with the alternating order of teeth 82 and corresponding tooth spaces between neighboring teeth 82. In other words, the cutting edges 84 of the teeth 82 are in no way obstructed by the ridge 150. Preferably, the elevated ridge 150 is a continuously extending ridge 150. In other words, at least in some embodiments, the spacing ridge 150 does not comprise an interruption or gap in the lateral extension. However, it is generally preferred that the spacing arrangement 140 is arranged adjacent, or even as close as possible, to the longitudinal ends (or, so to say, the tips) of the teeth 82 of the cutter 24.

As shown in FIGS. 13 and 14, the spacing ridge 150 comprises a basically rectangular cross-section. However, the respective arrangement is primarily provided for illustrative purposes. Preferably, the ridge 150 comprises a rounded or smoothened surface. Hence, a smooth contact with the second wall 102 of the stationary 22 is provided, refer also to FIG. 13. However, the rounded or smoothened surface is not required in each case as the dominant motion component is a reciprocating lateral relative motion between the cutter 24 and the stationary blade 22. As can be further seen from FIG. 13, the gap portion 132 at the second wall 102 is basically kept clear due to the spacing arrangement 140. In other words, the teeth 82 of the cutter 24 are at least slightly urged against the first wall 100 and therefore prevented from being lifted or bent away from the first wall 100. As a consequence, the gap portion 132 is not obstructed or blocked by the deflected teeth 82. Therefore, cut hair sections may be accommodated at or removed/discharged via the gap portion 132.

With reference to FIG. 15 and FIG. 16, an alternative embodiment of an elevated spacing arrangement 140 is illustrated and further described. By way of example, the elevated spacing arrangement 140 comprises a plurality of spacing element 160, particularly of dome-shaped or dome-segment shaped spacing elements 160. As can be further seen, the spacing elements 160 are arranged adjacent to frontal tips of the teeth 82 of the leading edge 80. For instance, each of the teeth 82 may be assigned with a respective spacing element 160 adjacent to the tip. In some embodiments, not necessarily each and any teeth 82 needs to be provided with a spacing element 160.

FIG. 15 illustrates that the spacing elements 160 are arranged to contact the second wall 102 at the gap portion 132. However, the gap portion 132 is not obstructed as the spacing arrangement 140 is, so to say, interrupted in its lateral extension. The spacing elements 160 do not protrude beyond the lateral extension of the teeth 82. Therefore, cut hair sections may be accommodated at the gap portion 132 and laterally removed or discharged from the blade set 20. The spacing arrangement 140, particularly the spacing ridge 150 or the spacing elements 160, is elevated with respect to the basically flat and planar shape of the bottom surface 136 of the cutter 24.

Figure 17:
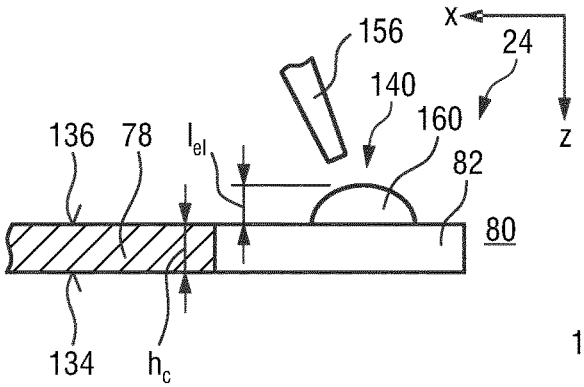
FIG. 17 is a simplified partial cross-sectional side view of an exemplary embodiment of an elevated spacing arrangement for a cutter of a blade set.
Figure 18:
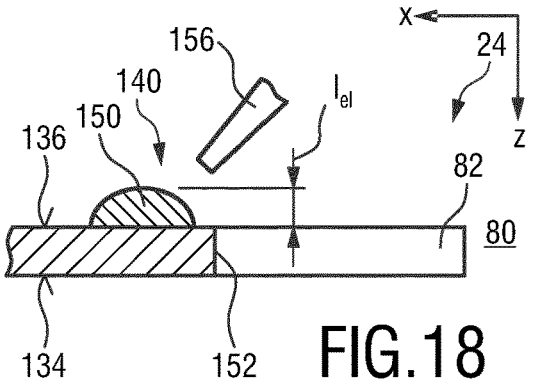
FIG. 18 is a simplified partial cross-sectional side view of another embodiment of an elevated spacing arrangement for a cutter of a blade set.
Figure 19:
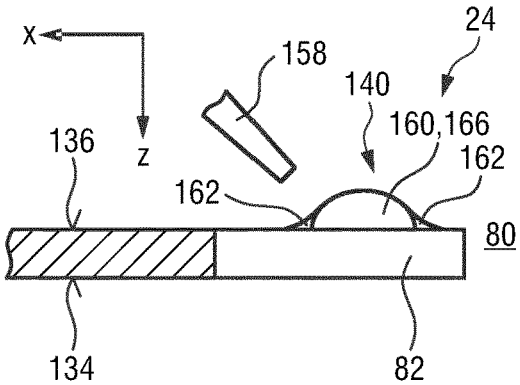
FIG. 19 is a simplified partial cross-sectional side view of another embodiment of an elevated spacing arrangement for a cutter of a blade set.
Figure 20:
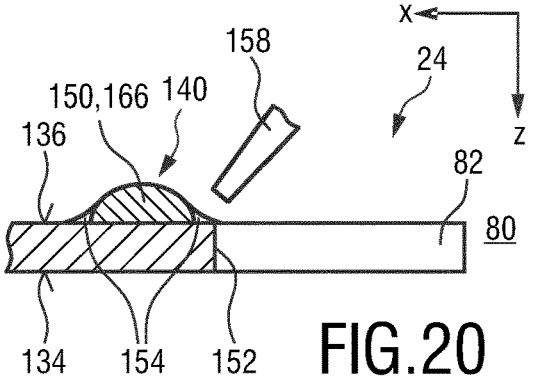
FIG. 20 is a simplified partial cross-sectional side view of another embodiment of an elevated spacing arrangement for a cutter of a blade set.

With reference to FIGS. 17 to 22, exemplary approaches for manufacturing or forming the spacing arrangement 140 at or adjacent to the toothed leading edge 80 of the cutter 24 are illustrated. FIG. 17 and FIG. 18 describe embodiments in which the elevated spacing arrangement 140 is formed through material deposition at the bottom surface 136 of the cutter. FIGS. 19 and 20 illustrate embodiments wherein the elevated spacing arrangement 140 is obtained through bonding a separate part or separate parts to the bottom surface 136.

Figure 21:
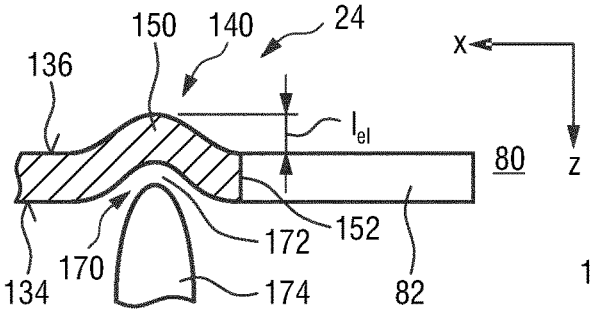
FIG. 21 is a simplified partial cross-sectional side view of another embodiment of an elevated spacing arrangement for a cutter of a blade set.
Figure 22:
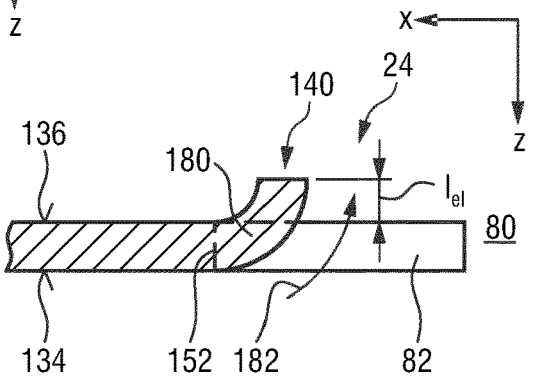
FIG. 22 is a simplified partial cross-sectional side view of another embodiment of an elevated spacing arrangement for a cutter of a blade set.

FIG. 21 and FIG. 22 refer to embodiments wherein the elevated spacing arrangement 140 is obtained through deforming the basically flat shape of the cutter 24 so as to form respective elevations at the bottom surface 136 thereof. FIG. 17 to FIG. 22 are simplified schematic partial cross-sectional side views of cutters 24, wherein the cross-section is oriented at a slot portion such that the tooth 82 illustrated in FIGS. 17 to 22 does not form part of the cross section. Rather, primarily the respective main portion 78 from which the toothed leading edge 80 and particularly the teeth 82 extend is shown in a cross-sectional state.

FIG. 17 illustrates an arrangement of the cutter 24 that is similar to the arrangement of FIG. 16. Similarly, spacing elements 160 are arranged at the teeth 82. By way of example, a deposition welding tool 156 or a similar material deposition tool may be provided so as to deposit material at the bottom surface 136 of the teeth 82. In this way, an elevated level $l_{el}$ with respect to the level of the bottom surface 136 may be obtained. An overall height of the cutter 24 at the spacing arrangement 140 may be therefore defined by the height of the cutter $h_c$ (which corresponds to the thickness of the sheet metal material the cutter 24 is made from) and the height of the elevated level $l_{el}$. As a consequence, the teeth 82 may be sufficiently spaced from the second wall 102, particularly from the gap portion 132. As a further consequence, the top surface 134 of the cutter 24, particularly of the teeth 82 thereof, may be brought into close contact with the first wall 100, particularly with the first legs 110 of the teeth 36, of the stationary blade 22, refer also to FIG. 15, for instance.

Similarly, as shown in FIG. 18, also a ridge-shaped spacing arrangement 140 may be obtained through the deposition of material at the top surface 136 with a material deposition tool 156, particularly a deposition welding tool. A corresponding ridge 150 of deposited material may be arranged adjacent to the tooth basis 152 of the cutter 24. The ridge 150 may basically extend in the lateral direction Y in a basically continuous fashion. In the alternative, the ridge 150 may be interrupted, i.e. extending in a discontinuous fashion in the lateral direction Y.

FIG. 19 illustrates an arrangement of the cutter 24 that is similar to the arrangement of FIG. 17. As with the embodiment of FIG. 17, a plurality of spacing elements 160 may be formed each of which is associated with a tooth 82. To this end, one or more separate spacing parts 166 may be provided and bonded to the bottom surface 136 of the cutter 24. Further, a bonding tool 158 may be used, for instance a welding or soldering tool. Correspondingly, bonding zones or spots 162 may be formed to fixedly attach the one or more separate spacing parts 166 to the cutter 24.

The embodiment of the cutter 24 of FIG. 20 basically corresponds to the embodiment of the cutter 24 of FIG. 18. Similarly, the spacing arrangement 140 comprises an elevated spacing ridge 150 that is arranged adjacent to the tooth basis 152. For instance, an elongated rod or tab may be provided which may be referred to as separate spacing part 166. By use of the bonding tool 158, the separate spacing part 166 may be fixedly attached to the bottom surface 136. Corresponding bonding zones are indicated by reference numeral 154 in FIG. 20.

FIG. 21 and FIG. 22 illustrate embodiments of cutters 24 that implement an elevated spacing arrangement 140 in accordance with at least some aspects of the present disclosure wherein no separate part or no separate material is deposited at or attached to the basically flat intermediate form of the cutter 24. Rather, the elevated spacing arrangements 140 of FIG. 21 and FIG. 22 are obtained trough deforming the basically flat planar shape thereof. Also in this way a resulting elevated level $l_{el}$ of the spacing arrangements 140 with respect to the bottom surface 136 may be obtained.

In FIG. 21, a depressed arrangement 170 is provided which basically corresponds to the elevated spacing arrangement 140. In other words, the depressed arrangement 170 is composed of the recess or depression 172 at the top surface 134. Correspondingly, an elevated ridge-like shape may be formed at the bottom surface 136 which eventually forms the elevated spacing arrangement 140 of the embodiment of the cutter 24 as shown in FIG. 21. As further indicated in FIG. 21, an elevated spacing ridge 150 may be formed by applying a respective deforming tool 174, particularly a coining or stamping tool 174. Preferably, the tool 174 engages the cutter 24 at the top side 134 thereof so as to form the recess or depression 172 that corresponds to the desired ridge 150 at the bottom surface 136. Hence, the elevated spacing arrangement 140 may be obtained through ribbing, stamping, coining or beading or through similar material forming processes. Similarly, also elevated spots, such as elevated spacing elements 160 at the teeth 82 may be formed with punch spikes or similar spot-forming tools. Generally, a permanent (plastic) deformation or displacement may be induced so as to define the elevated spacing arrangement 140.

FIG. 22 illustrates another alternative embodiment of a spacing arrangement 140 which comprises at least one bent tab 180. Preferably, a plurality of bent tabs 180 is provided each of which is arranged between neighboring teeth 82. A bent direction is indicated in FIG. 22 by reference numeral 182. By bending the flat portions of the cutter 24 in a defined manner, the desired resulting elevated level $l_{el}$ of the spacing arrangement 140 with respect to the bottom surface 136 may be obtained. Needless to say, the bent tabs 180 may be further processed so as to obtain a curved, rounded or smoothened surface.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade set for a cutting appliance, said blade set being arranged to be moved through hair in a moving direction to cut hair, said blade set comprising:

a stationary blade comprising a first wall arranged to serve as a skin facing wall when in operation, a second wall at least partially offset from the first wall, such that the first wall and the second wall define therebetween a guide slot, at least one first toothed leading edge jointly formed by the first wall and the second wall, wherein the at least one first toothed leading edge comprises a first plurality of teeth, and wherein the first wall and the second wall are connected at a frontal end of the at least one first toothed leading edge, thereby forming tips of the first plurality of teeth; and a cutter comprising a substantially flat main portion made from sheet metal material, at least one second toothed leading edge protruding from the main portion, the at least one second toothed leading edge comprising a second plurality of teeth, the second plurality of teeth being movably arranged within the guide slot defined by the stationary blade, such that, upon relative motion between the cutter and the stationary blade, the at least one second toothed leading edge of the cutter cooperates with corresponding teeth of the first toothed leading edge to enable cutting of hair caught therebetween in a cutting action, wherein the cutter comprises a first surface facing the skin when the hair cutting appliance is in operation and a second surface facing away from the first surface and facing away from the skin when the cutting appliance is in operation, wherein the cutter, on the second surface, comprises at least one elevated spacing member configured for spacing the at least one second toothed leading edge of the cutter away from the second wall, wherein the at least one elevated spacing member is elevated with respect to the at least one second toothed leading edge of the cutter.

2. The blade set as claimed in claim 1, wherein the at least one elevated spacing member is arranged to contact the second wall of the stationary blade to space respective second teeth of the cutter away from the second wall of the stationary blade.

3. The blade set as claimed in claim 2, wherein gap portion is formed at the guide slot by the second wall in juxtaposed to the at least one first toothed leading edge, and wherein the at least one elevated spacing member is arranged to contact the second wall at the gap portion or adjacent to the gap portion.

4. The blade set as claimed in claim 2, wherein a gap portion is formed by an at least partially concavely shaped internal indentation of the second wall, wherein the gap portion is arranged to provide a remaining gap between the second wall and the at least one second toothed leading edge of the cutter, and wherein the gap portion is adapted to accommodate cut hairs.

5. The blade set as claimed in claim 1, wherein the at least one elevated spacing member is configured to contact the second wall to urge the first surface of the cutter at the at least one second toothed leading edge of the cutter into contact with the first wall.

6. The blade set as claimed in claim 5, wherein the at least one elevated spacing member is configured to urge the first surface of the cutter at the at least one second toothed leading edge of the cutter into close contact with the first plurality of teeth of the stationary blade.

7. The blade set as claimed in claim 1, wherein the at least one elevated spacing member is arranged within an at least partially concavely shaped internal indentation of the second wall to prevent a rearward deflection of the at least one second toothed leading edge of the cutter.

8. The blade set as claimed in claim 1, wherein the at least one elevated spacing member is bulge-shaped or dome-shaped.

9. The blade set as claimed in claim 1, wherein the at least one elevated spacing member comprises an elevated laterally extending spacing ridge protruding from an otherwise planer portion of the second surface of the cutter, wherein the laterally extending spacing ridge is arranged adjacent to tooth bases of the second plurality of teeth of the cutter and adapted to contact the second wall of the stationary blade.

10. The blade set as claimed in claim 9, wherein the elevated laterally extending spacing ridge protruding from the second surface of the cutter is a continuous elevated laterally extending spacing ridge.

11. The blade set as claimed in claim 1, wherein the at least one elevated spacing member comprises a plurality of elevated spacing members protruding from an otherwise planer portion of the cutter, and wherein the plurality of elevated spacing members are adapted to contact the second wall of the stationary blade.

12. The blade set as claimed in claim 11, wherein the plurality of elevated spacing members are arranged on the second plurality of teeth of the cutter, and wherein each one of the plurality of elevated spacing members is positioned on a respective tooth of the second plurality of teeth.

13. The blade set as claimed in claim 1, wherein the stationary blade is an integrally formed metal-plastic composite stationary blade, and wherein the first wall is at least partially made from metal material, and wherein the second wall is at least partially made from plastic material.

14. The blade set as claimed in claim 1, wherein a first leading edge and a second leading edge is jointly formed by respective first and second leading edges of the cutter and the stationary blade, wherein the first leading edge and the second leading edge are spaced from one another and arranged at opposite longitudinal ends of the blade set, wherein the at least one elevated spacing member is a first elevated spacing structure associated with the first leading edge, and wherein a second elevated spacing structure is associated with the second leading edge.

15. The blade set as claimed in claim 1, wherein a at least one depression is provided at the first surface of the cutter that is opposite to the second surface of the cutter, wherein the at least one depression and the at least one elevated spacing member are integrally formed in a corresponding fashion.

16. The blade set as claimed in claim 1, wherein the at least one elevated spacing member is a material deposited on the second surface of the cutter.

17. The blade set as claimed in claim 16, wherein the material deposited is deposited by deposition welding.

18. The blade set as claimed in claim 1, wherein the at least one elevated spacing member is at least one spacing member bonded to the second surface of the cutter.

* * * * *